United States Patent [19]

McMahan

[11] 4,379,378

[45] Apr. 12, 1983

[54] AUDITORIUM CONVERTIBLE FLOOR

[76] Inventor: Norman C. McMahan, 3976 Black Oak Dr., Shingle Springs, Calif. 95682

[21] Appl. No.: 251,639

[22] Filed: Apr. 6, 1981

[51] Int. Cl.[3] ..... E04N 3/12

[52] U.S. Cl. ..... 52/9

[58] Field of Search ..... 52/8, 9, 10, 263; 297/243

[56] References Cited

U.S. PATENT DOCUMENTS

| | | | |
|---|---|---|---|
| 686,520 | 11/1901 | Hutton, Jr. | 297/243 |
| 871,624 | 11/1907 | Pitcher | 297/243 |
| 3,092,876 | 6/1963 | Cornberg | 52/9 |
| 3,443,835 | 5/1969 | Brunskole | 52/9 |
| 4,211,450 | 7/1980 | Sutter | 52/9 |
| 4,294,048 | 10/1981 | Sutter | 52/9 |

*Primary Examiner*—Peter M. Caun

*Attorney, Agent, or Firm*—Lothrop & West

[57] ABSTRACT

An auditorium construction can be interconverted between a level, clear floor in removable sections and an arrangement of a plurality of regularly disposed theatre seats. The separate floor sections can be removed and horizontal, support columns can be swung into a releasably locked vertical position, carrying with them theatre seats moving from a horizontal position into a vertical position. Additional floor panels are then placed between rows of the erected theatre seats and overlying the previously stowed clear floor sections. A reverse operation returns the theatre seats to horizontal position and restores the clear floor.

9 Claims, 10 Drawing Figures

FIG-4
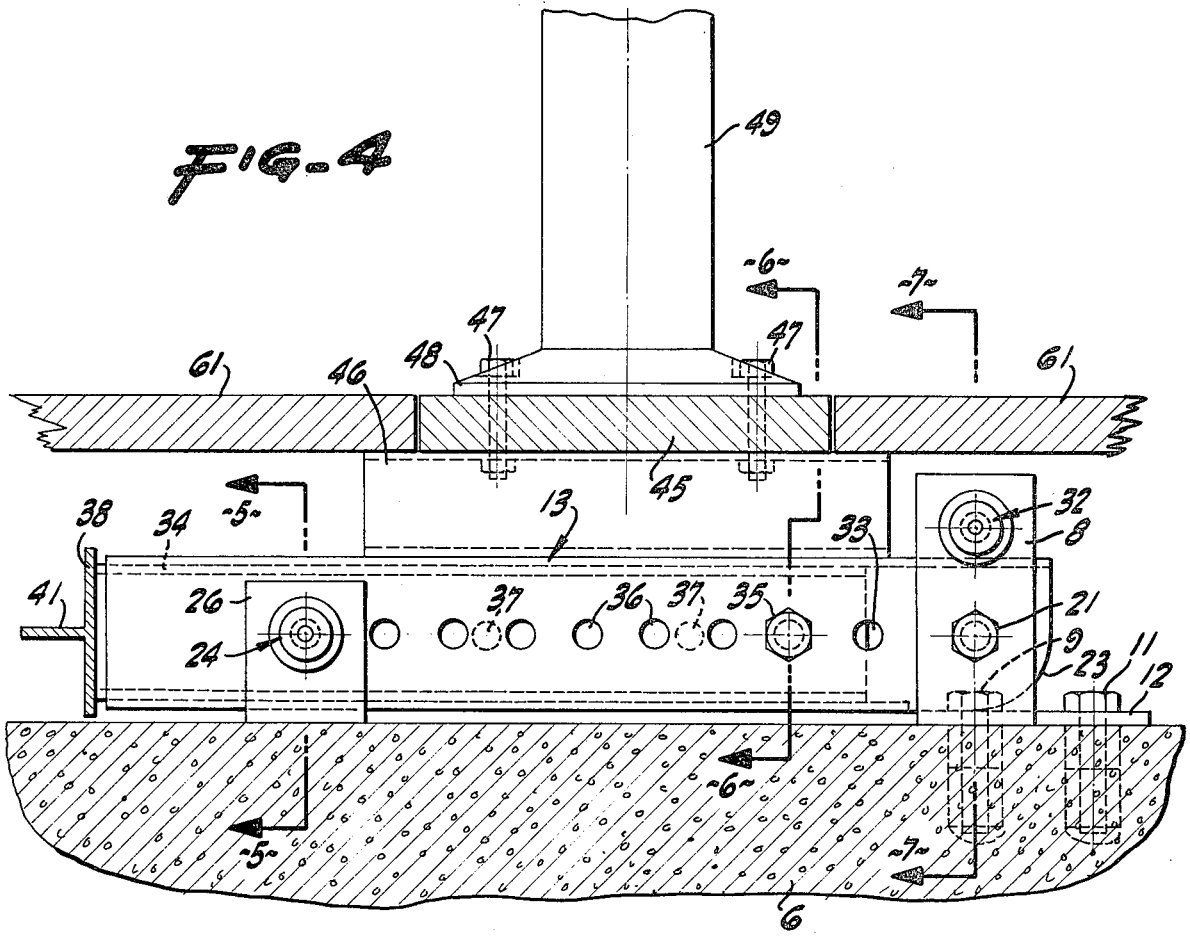
FIG-5
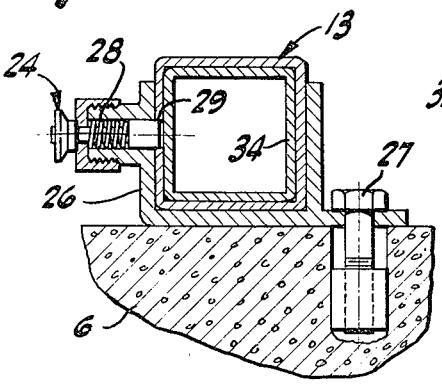
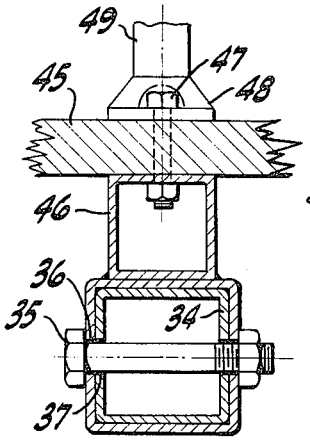
FIG-6
FIG-7
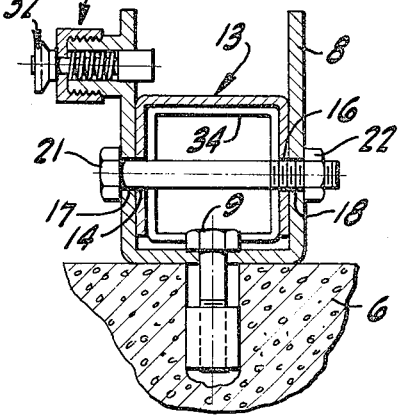

AUDITORIUM CONVERTIBLE FLOOR

BRIEF SUMMARY OF THE INVENTION

The invention relates to the construction of an auditorium useable in two conditions, one being an arrangement in which the auditorium is covered or is provided with a smooth blank floor made up of interfitting sections, and in the other of which there is provided a plurality of theatre seats resting on or useable with a level floor.

BRIEF DESCRIPTION OF THE SEVERAL VIEWS OF THE DRAWINGS

FIG. 4 is an enlarged view showing one of the chair portions and its attendant structure when in position with the chair erected in useable position.

FIG. 5 is a cross-section, the plane of which is indicated by the line 5—5 of FIG. 4.

FIG. 6 is a cross-section, the planes of which are indicated by the lines 6—6 of FIG. 4.

FIG. 7 is a cross-section, the plane of which is indicated by the line 7—7 of FIG. 4.

DETAILED DESCRIPTION

Figure 1:
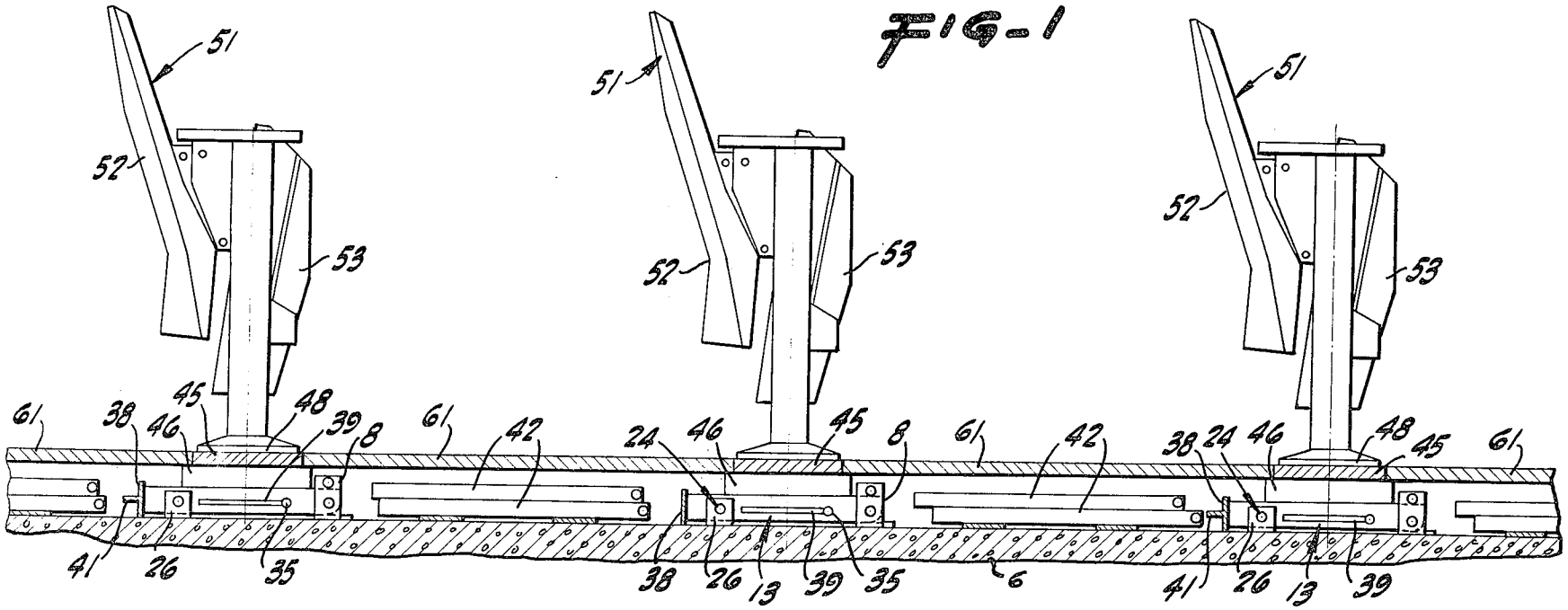
FIG. 1 is a cross-section on a longitudinal vertical plane through a portion of the auditorium showing theatre seats in erected and useable condition.

In one form of the construction, there is provided a substructure 6 which may be a reinforced concrete floor or other suitable generally planar and horizontal support extending throughout the area of the auditorium or enclosure within which the floor structure is housed. On the sub-structure at appropriate intervals transversely of the floor or auditorium and at appropriate intervals longitudinally of the floor or auditorium, and usually in alignment with each other, there are provided a number of sub-structure brackets 8. These are channels open at the upper end and are appropriately secured to the sub-structure by fasteners 9 and if necessary by additional fasteners 11 passing through tabs 12 extended from the channel brackets 8.

Pursuant to the invention, the brackets 8, considered as pairs transversely of the auditorium, are each provided with a column leg 13. This is substantially a rectangular box member near its lower end having a pair of apertures 14 and 16 that can be aligned with similar apertures 17 and 18 in the flanges of the members 8. A bolt 21 and securing nut 22 are passed through the appropriate horizontally and transversely aligned apertures. The corner of the column leg 13 is rounded, as at 23, so that there is provided a pivotal interrelationship between the upstanding bracket 8 and the column leg 13. By this means the column leg is readily movable or pivotable between a horizontal position and a vertical position. The parts can be held in a horizontal position by a detent 24 (FIG. 5) mounted in a holder 26 secured to the sub-structure by a fastener or fasteners 27 and urged by a spring 28 into a position in which the detent 24 interengages with a corresponding opening 29 in the column leg 13.

Figure 8:
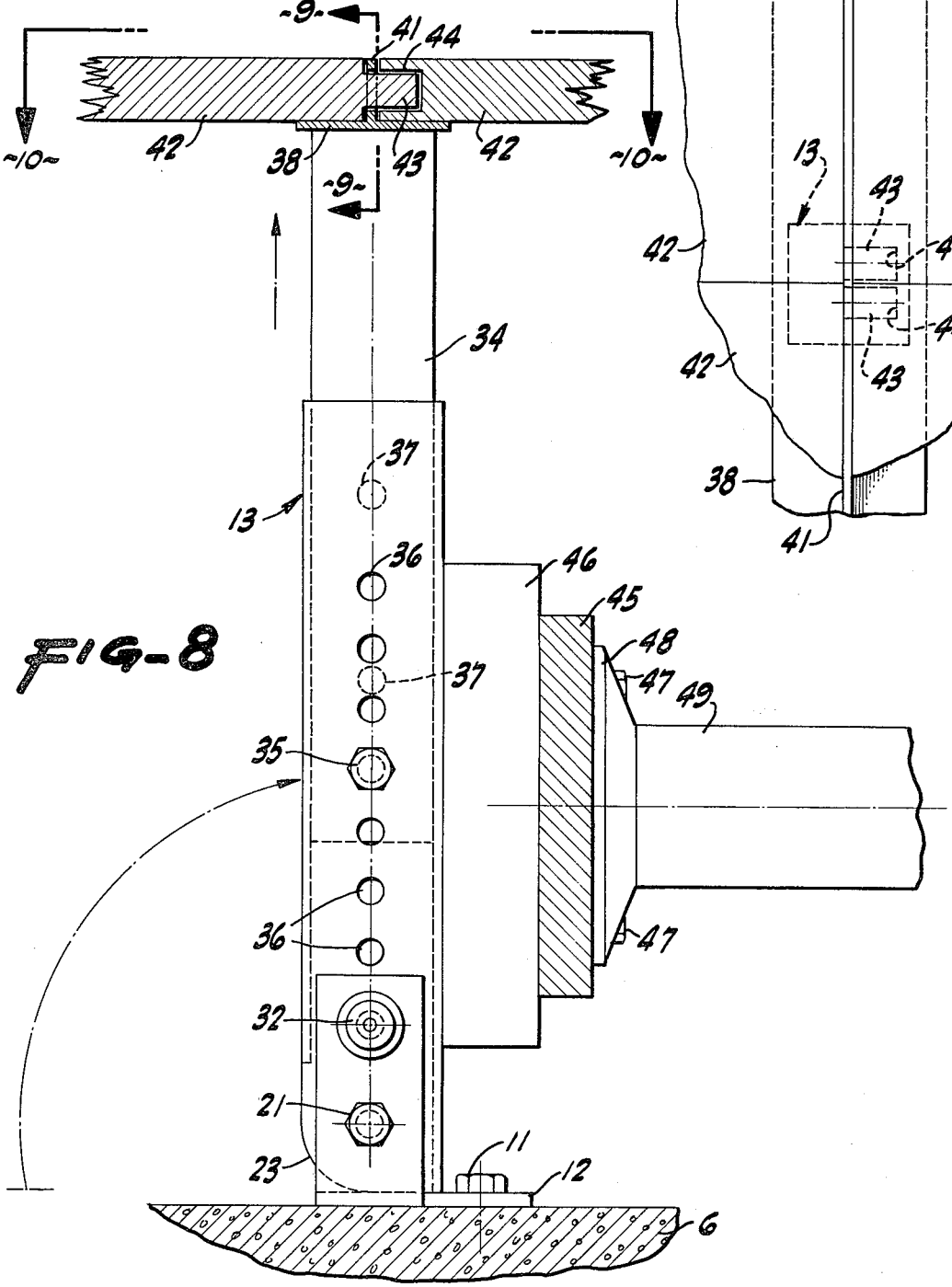
FIG. 8 is a view comparable to FIG. 4 but showing the parts in position with the theatre chairs stowed and the plain floor in position.

When the detent 24 is withdrawn and so is released, the column leg is rotatable through approximately ninety degrees, as shown in FIG. 8, between a horizontal position and a vertical position and can also be locked in the vertical position. A similar arrangement is employed in that the bracket 8 has a lock mechanism 31 including a spring-pressed plunger 32 like the plunger 24 and effective when the column leg 13 is in vertical position to interfit with an aperture 33 (FIG. 4) therein.

Figure 2:
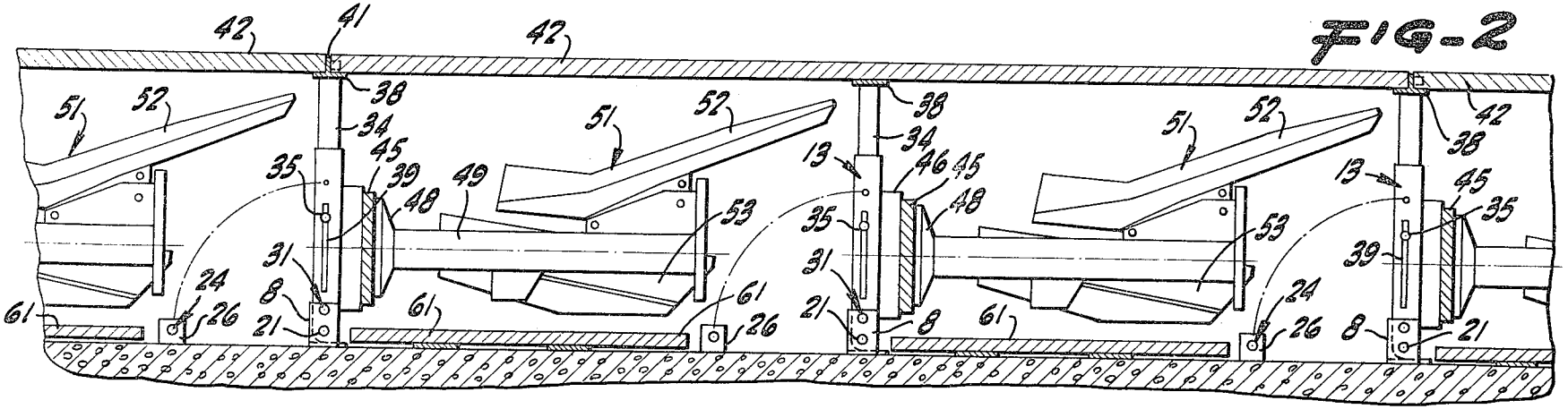
FIG. 2 is a view similar to FIG. 1 but with the theatre chairs folded and out of the way to make available a smooth, clear floor.
Figure 3:
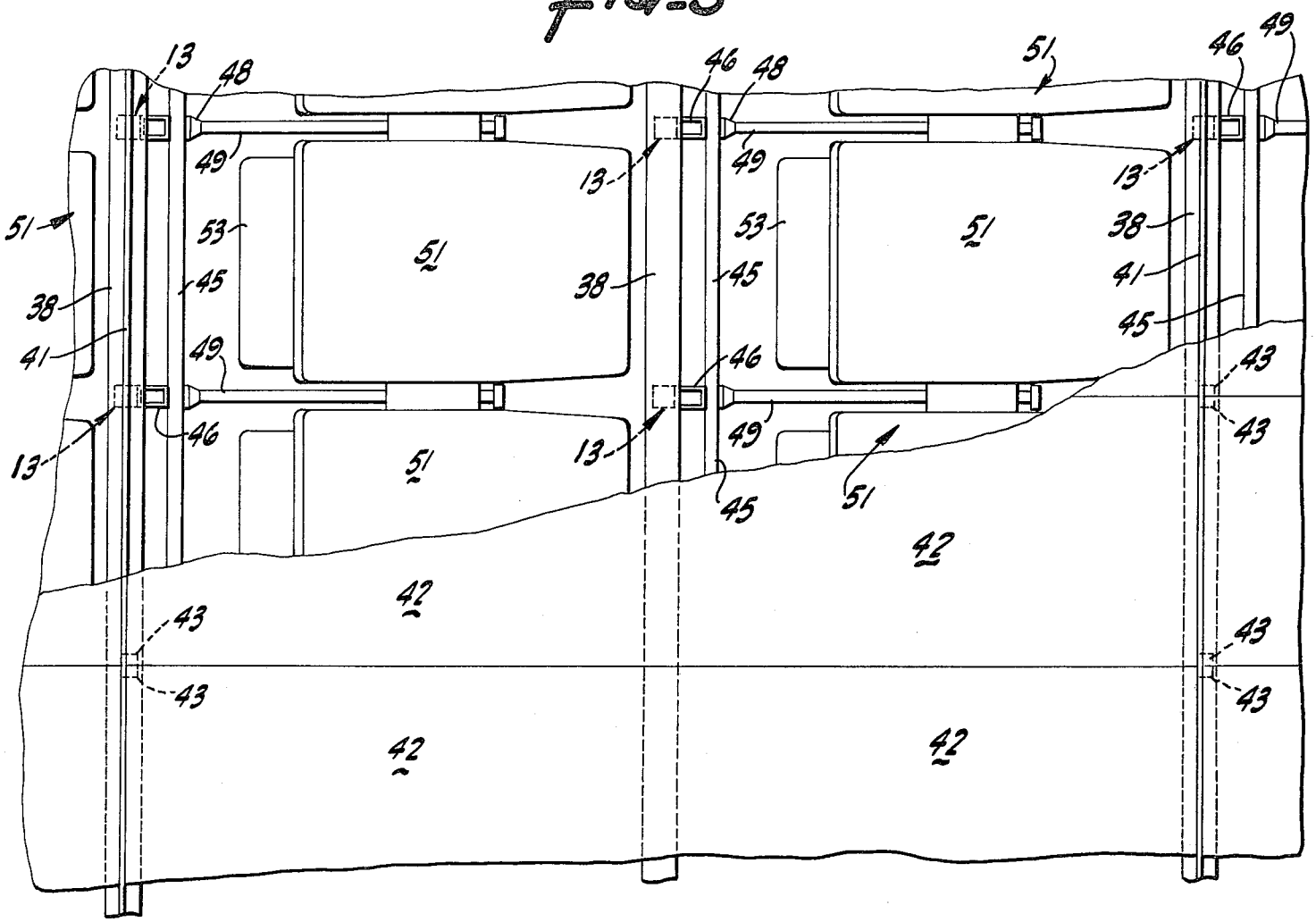
FIG. 3 is a plan of the arrangement shown in FIG. 2 with some of the clear floor appearing and in other locations with the clear floor broken away to show the folded, stowed chairs therebeneath.

The column base or leg 13 preferably telescopes with a relatively sliding floor support 34, preferably of generally box-like cross-section. The two relatively slidable members 13 and 34 can be held in an intermediate position or positions by a through bolt 35 that is readily removable from and re-engageable with any aligned apertures 36 and 37 in the adjustable members 34 and in the column legs 13. In this fashion, the upper ends of the floor supports 34 can be set at any desired height from the sub-structure 6 within the range of positions of the bolt holes 36 and 37. Transverse bars 38 rest on the supports 34. In some instances, the various bolt holes 37 are merged to provide a continuous slot 39 (FIG. 2), so that while the through bolt is in one position it can serve as a clamp for holding the relatively movable parts of the leg 13 in any intermediate position.

Figure 9:
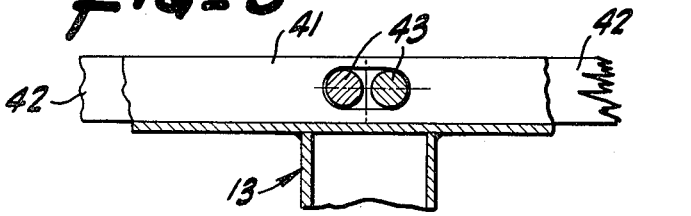
FIG. 9 is a cross-section, the plane of which is indicated by the line 9—9 of FIG. 8.
Figure 10:
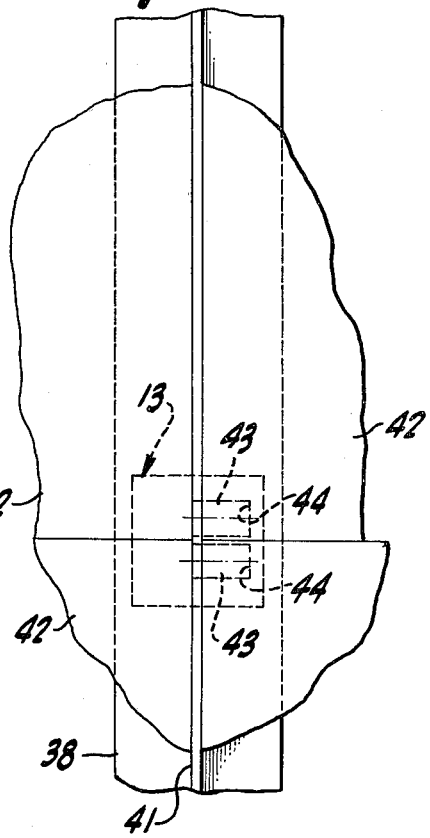
FIG. 10 is a plan of the structure shown in FIG. 8, the view being indicated by the line 10—10 of FIG. 8.

Some of the bars 38 on the floor supports 34 are preferably T-members installed inverted to provide upstanding flanges 41 when the parts are in the position shown in FIGS. 8 and 9, for example. In this orientation of the structure, there can be provided floor panels 42 sized and positioned to rest upon the bars 38 or T-bars. There are interfitting tongue members 43 and groove members 44 or sockets in the opposite edges of the floor panels 42. With this arrangement, when the parts are all in position and the floor panels 42 are positioned and interfitted, there is afforded a planar, clear floor appropriately positioned and anchored to the similarly anchored upright column legs, so that any weight on the floor 42 is transmitted downwardly through the column legs 13 to the sub-structure 6. For this reason, and depending somewhat on the spacing of the various support members, the floor panels 42 can bear any desired load, even a rather substantial one.

The various columns are spaced apart laterally in accordance with the transverse width of the auditorium, and the interfitting portions 43 and 44 of the floor panels 42 are arranged either just above the columns or at appropriate intervals so that unwanted movement of the floor panels is not permitted and the floor is adequate for games, dancing, marching, or the like, in which sometimes rather severe horizontal forces are present. These forces, however, are adequately resisted both in a fore-and-aft direction and in a transverse direction, so that the floor is at least as useful as the standard, open floor dance hall, gymnasium, or the like.

To convert the auditorium from the clear or plain floor arrangement to one with theatre seats, the floor panels 42 are dismantled, beginning at one portion of the room, and are preferably stowed, as shown in FIG.

1, directly on the sub-structure 6 and between the mechanisms for the individual seats.

Groups of the side-by-side column legs 13 engage transversely disposed stringers 45 through interposed spacer boxes 46 secured thereto by bolts 47, as shown in FIG. 4. Each spacer box 46 thus supports the bottom flange 48 of the pedestal 49 of a theatre chair 51 having the customary back 52 and the customary seat 53. These latter parts are relatively movable about a transverse axis, so that the seat 53 can be folded up as shown in all of the figures herein or can, as customary, be folded down to an approximately horizontal position.

So that the chairs 51 can be utilized after the floor panels 42 have been removed, the columns 34 are rotated about the bolts 21, so that the columns are in a horizontal position, as shown in FIG. 1, and the chairs 51 are in a vertical position, as shown in that figure.

When the chairs are all in the upright or erected position, various new floor panels 61 are retrieved from storage and are positioned so that they rest upon the extended ends of the spacer boxes 46. These panels 61 abut the stringers 45 at the same elevation. The floor panels 61 thus occupy substantially all of the clear spaces between the various chairs 51. In this position of the parts, and in order to make sure that everything is solid and secure, the detents 24 are permitted to interengage with the apertures 29 in the column legs 13. Under these conditions, transverse forces on the seat supports or on the chairs themselves do not move the supporting and holding arrangement.

It will thus be appreciated that with the arrangement disclosed it is possible to provide an auditorium with a clear, uninterrupted and substantially continuous level floor or, by relatively simple changes, to convert the auditorium into one in which there are rows of chairs in position for occupancy with an additional floor for use between and around the sundry chairs.

I claim:

1. An auditorium convertible floor comprising a sub-structure, a base on said sub-structure, a column, means for pivoting said column on said base to move relative to said base between a horizontal position and a vertical position, means for holding said column in said vertical position, a theatre chair having a frame movable between a horizontal position and a vertical position, means for securing said frame and said column together with said column extending above said theatre chair when said column is in said vertical position and said chair is in said horizontal position, a floor support, means for interconnecting said floor support and said column, and a floor section adapted to interengage said floor support.

2. A device as in claim 1 in which said means for holding said column in said vertical position is releasable.

3. A device as in claim 1 in which said theatre chair includes a seat pivoted to turn on said frame about a predetermined horizontal axis, and said means for pivoting is effective about an axis parallel to said predetermined horizontal axis.

4. A device as in claim 1 in which said frame securing means holds said theatre chair in said horizontal position and spaced substantially above said sub-structure to leave a clear volume therebetween.

5. A device as in claim 1 including a column leg, a floor support movable with respect to said column leg, and means for moving said floor support relative to said column leg to change the length of said column.

6. A device as in claim 1 in which said column includes two members relatively movable to change the length of said column, and means for holding said members against said relative movement.

7. A device as in claim 1 in which said column includes a lug extending from one end thereof, and a floor section including means for interfitting with said lug.

8. A device as in claim 1 in which said floor support is an inverted T-bar and said floor section is adapted to lie on said inverted T-bar.

9. A device as in claim 1 including a flange projecting beyond the free end of said column and in which said floor section includes a tongue adapted to interfit with said flange.

* * * * *